US005743036A

United States Patent [19]

Zumwalt

[11] Patent Number: 5,743,036

[45] Date of Patent: Apr. 28, 1998

[54] FILING SYSTEM

[76] Inventor: Frank E. Zumwalt, 2044 Colquitt, Houston, Tex. 77098

[21] Appl. No.: 715,164

[22] Filed: Sep. 17, 1996

[51] Int. Cl.[6] ..... B42F 21/00

[52] U.S. Cl. ..... 40/359; 229/67.1; 283/36

[58] Field of Search ..... 40/359, 360; 229/67.1, 229/67.2; 283/36, 37, 38, 39, 40, 41, 42, 43

[56] References Cited

U.S. PATENT DOCUMENTS

| | | | |
|---|---|---|---|
| 876,319 | 1/1908 | Bradway | 40/360 X |
| 981,366 | 1/1911 | Boyce . | |
| 1,058,118 | 4/1913 | Wardy | 40/359 X |
| 1,336,584 | 4/1920 | Ringer | 40/359 X |
| 1,490,344 | 4/1924 | Poulin | 40/359 X |
| 1,674,222 | 6/1928 | Quigley | 40/359 |
| 2,303,671 | 12/1942 | Walraven | 283/38 |
| 3,962,807 | 6/1976 | Pantone | 40/78.15 |
| 4,204,639 | 5/1980 | Barber et al. | 235/462 |
| 4,300,791 | 11/1981 | Bohrer et al. | 283/38 |
| 4,329,191 | 5/1982 | Barber | 156/64 |
| 4,659,110 | 4/1987 | Polk | 283/42 X |
| 4,932,683 | 6/1990 | Perazza | 283/74 |
| 4,949,999 | 8/1990 | Ke-hui | 283/36 X |
| 5,174,606 | 12/1992 | Hure | 281/45 |
| 5,197,764 | 3/1993 | Hicinbothem et al. | 40/359 X |
| 5,242,197 | 9/1993 | Raynak | 283/37 |
| 5,288,107 | 2/1994 | Johnson et al. | 283/81 |
| 5,449,202 | 9/1995 | Nalepka et al. | 283/81 |

FOREIGN PATENT DOCUMENTS

| | | | |
|---|---|---|---|
| 1536657 | 1/1970 | Germany | 40/359 |

*Primary Examiner*—Brian K. Green
*Assistant Examiner*—Andrea Chop
*Attorney, Agent, or Firm*—Baker & Botts, L.L.P.

[57] ABSTRACT

A filing system having at least one file folder for holding documents. The file folder has at least one V-shaped notch along the top of the file folder which is designed to provide a location for the placement of identifying data such as alphabetical index information, bar codes and magnetic strips. The V-shaped notch is marked with a bold strip to indicate which half of the alphabet is desired for identification of the file folder.

15 Claims, 2 Drawing Sheets

FIG. 1
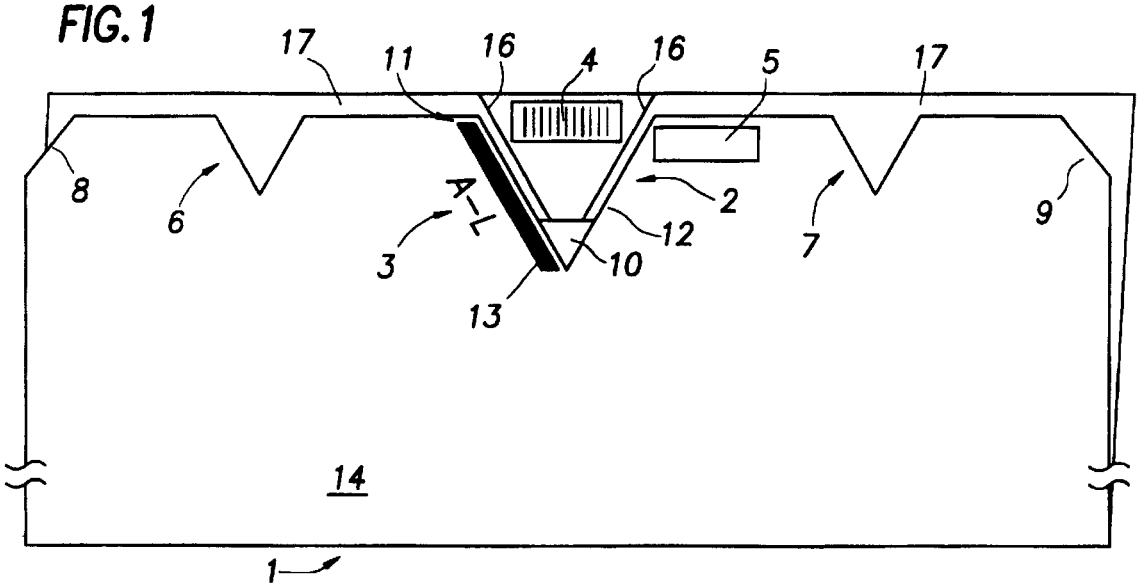
FIG. 2
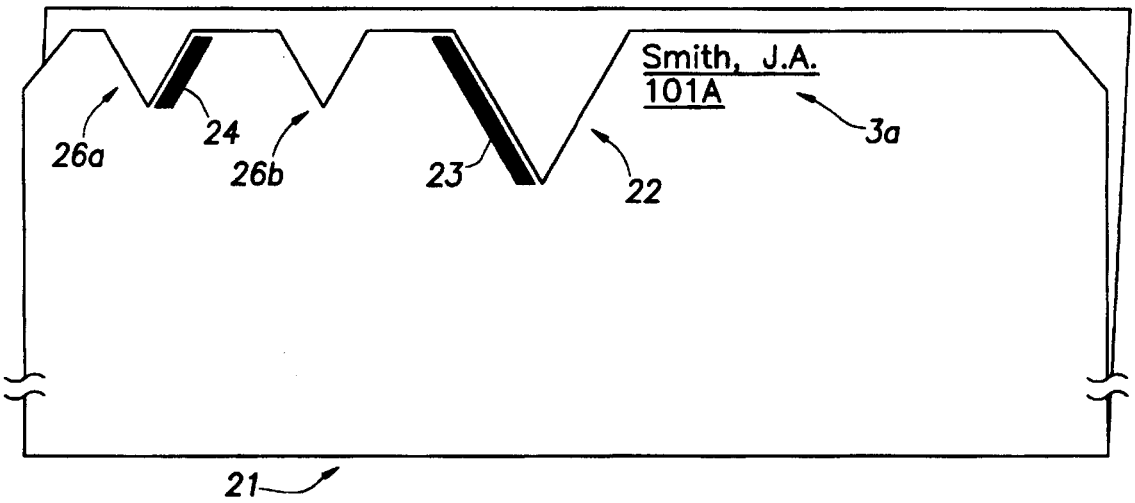
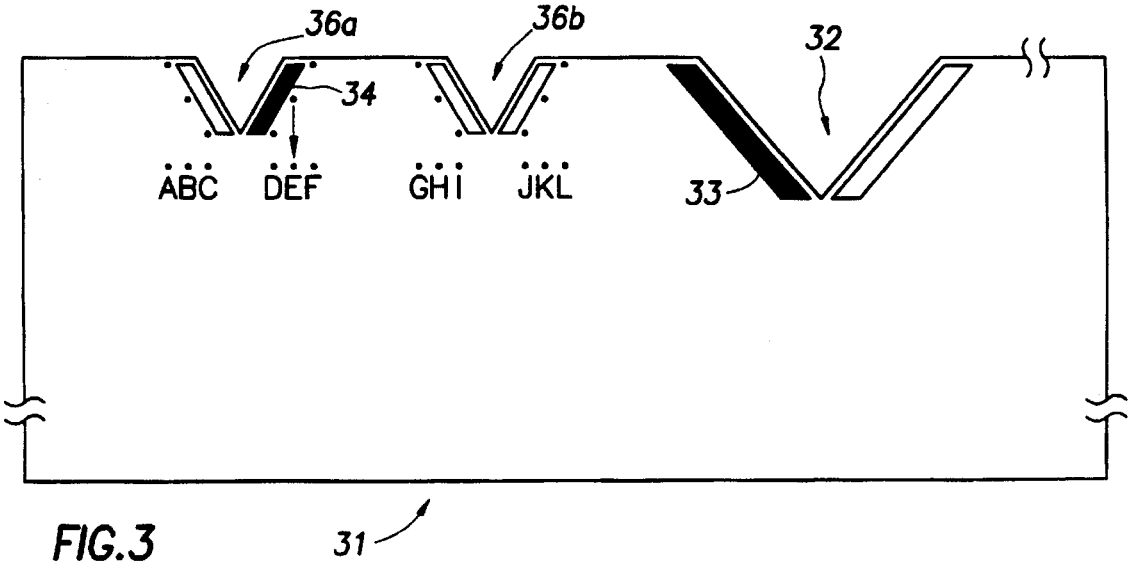
FIG. 3

FIG.4
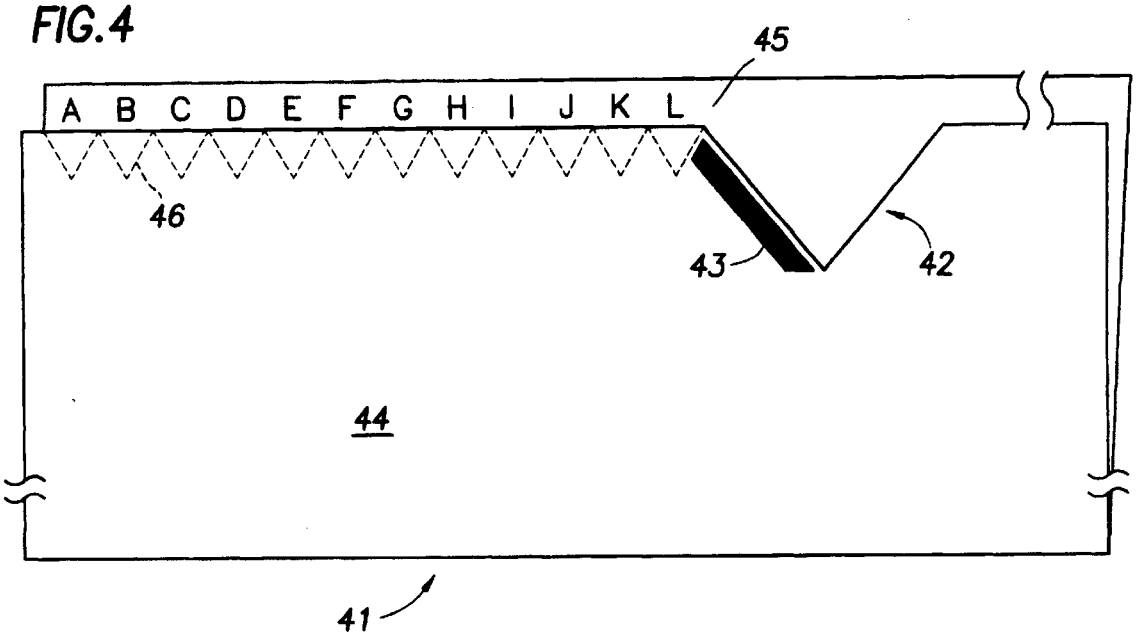
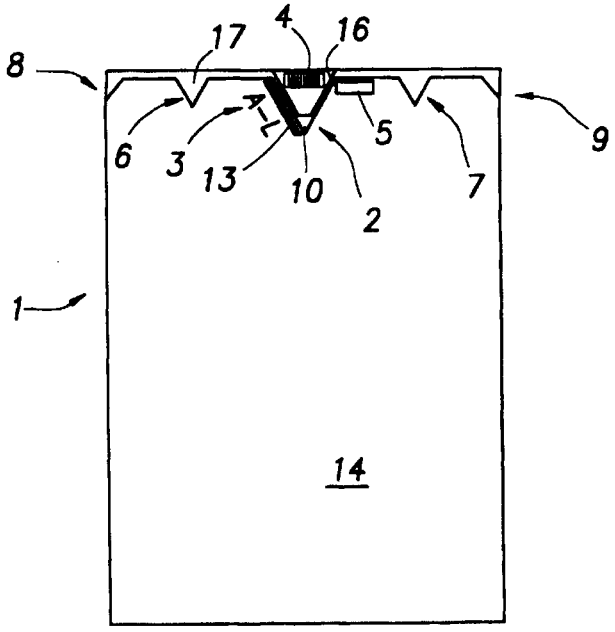
FIG.5
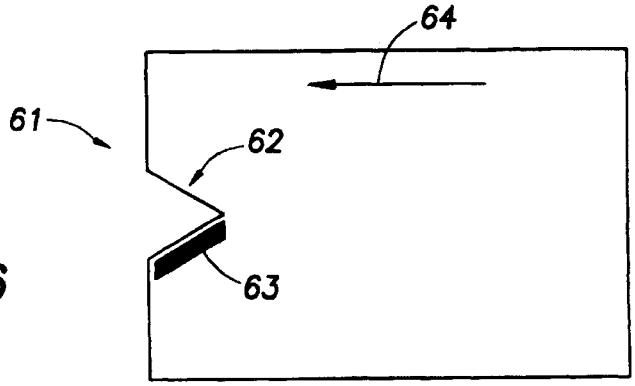
FIG.6

FILING SYSTEM

BACKGROUND OF THE INVENTION

1. Field of the Invention

This invention relates to a filing system that allows a user to index, identify and access filed documents with greater ease and efficiency. More specifically, this filing system comprises the use of file folders or pockets with V-shaped notches which facilitate the visual identification of files, the grasping and retrieving of filed documents, and provides a reference point for the placement of identifying features such as alphabetical index information, bar codes, and magnetic strips.

2. Description of the Related Art

The typical file folder presently in use has a front and a back, is inserted laterally into a file drawer, and contains a tab protruding upward which provides a location for placing identifying information. When the file drawer is opened, the information on the protruding tab of each folder can be seen by the user. The simplest folders are made of heavy manila stock paper or some other similarly heavy paper and have one or more score lines between the opposing sections so that, depending on how the user chooses to fold it, the width of the folder can be varied. This type of folder is typically used to store and organize loose documents.

More complex expandable folders have accordion folded side and bottom sections which allow the folder to expand as more documents are placed inside. This type of folder may contain multiple internal compartments with dividers between the compartments which have tabs arranged in a horizontally or vertically tiered manner. This method of arrangement allows the user to simultaneously identify information placed on all the tabs. For example, U.S. Pat. No. 4,932,683 to Perazza discloses a multi-document filing system consisting of a tiered multi-pocket file folder which is inserted into an outer file jacket.

Identifying information of various types may be placed on the various types of file folders, including, among others, written textual descriptions, alphanumeric codes, color codes and bar codes.

Although the prior art teaches a variety of different folder configurations and identifying or labeling schemes, there are remaining problems. The folders are often cumbersome to use because the documents cannot easily be accessed without removing the entire folder from the file drawer or other storage facility. The file labels are frequently situated on the file in a manner that hinders user access to the material contained in the file. The labels with simple written text or color codes can be identified by a user, but not by a scanning machine. In large filing systems, identification by the user, even using text and color-coding, can be time-consuming and unwieldy. Also, the prior art folders do not provide for a time-efficient method of filing in a desired order. Machine readable labels can be identified with the use of a scanning machine but are almost impossible for the user to recognize. Additionally, the prior art does not provide for placement of machine readable labels in a consistent position, such that large groups of files can easily be machine scanned to locate desired files.

SUMMARY OF THE INVENTION

Thus, a need exists for a filing system where a file folder can be quickly and easily visually identified by a user, the labels can be efficiently identified by both the user and a machine, the contents of a file folder can be easily and rapidly accessed, and the file folders can be filed in a desired order in a time-efficient manner.

In accordance with the present invention, a filing system is provided that allows the user to index, identify and access files and filed documents with greater ease and efficiency. More specifically, the present invention relates to a filing system having file folders or pockets with V-shaped notches which facilitate the visual identification of files, the grasping and retrieving of filed documents, and provides a reference point for the placement of identifying features such as alphabetical indexes, bar codes and magnetic strips.

Accordingly, an object of the present invention is to provide a file folder that can be easily identified by a user or by a scanning device. A further object of the present invention is to provide a file folder that provides the user with greater ability to quickly perceive and easily retrieve the contents of the file folder. Another object of the present invention is to provide a uniform location on file folders for the placement of identifying information and to provide the user with a convenient reference point for rapidly locating the information.

BRIEF DESCRIPTION OF THE DRAWINGS

A better understanding of the invention can be obtained when the detailed description of exemplary embodiments set forth below is considered in conjunction with the attached drawings in which:

FIG. 1 shows an embodiment of a file folder showing the placement of magnetic strips and bar codes in the vicinity of the first V-shaped notch.

FIG. 2 shows an embodiment of a file folder providing for the division of the alphabet into eight portions for sorting files.

FIG. 3 shows an embodiment where a user can indicate which eighth of the alphabet a file is located in and designate an individual letter for the file.

FIG. 4 shows an embodiment where the user may cut V-shaped notches from the front cover to correspond to a desired individual letter of the alphabet printed on the back cover of the file folder.

FIG. 5 shows a vertical file folder corresponding to the FIG. 1 embodiment.

FIG. 6 shows a side-viewed file where the V-shaped notch is located on the side of the file folder.

DETAILED DESCRIPTION OF THE EXEMPLARY EMBODIMENTS

The present invention comprises a novel filing system having at least one file folder for holding documents. This new filing system allows the user to index, identify and access filed documents with greater ease and efficiency. As used herein the term "file folder" includes: the typical file folder having a front cover and back cover with open sides; file pockets having a front, a back and closed sides; and other devices for holding documents desired to be filed, including without limitation, file jackets and other types of file folders and file pockets, regardless of materials of construction, such as paper or cardboard stock and opaque, translucent or transparent materials such as plastic.

Generally, along the top of the file folder is at least one V-shaped notch which is designed to provide a location for the placement of identifying data. Here, the term "top" refers to that portion of the file folder which will be viewed by a user accessing the filing system and generally relates to the top for top-viewed filing systems such as file drawers or file cabinets, but also refers to the side of a file folder for side-viewed filing systems, i.e., where it is desired that the filing system be viewed from the side, such as in wall mounted filing shelves. (See discussion relating to FIG. 6, below.) Without limiting the invention, the invention will be described with relation to top-viewed filing systems where the filing system is viewed from the top, such as file cabinets, file drawers, boxes of stored documents, etc.

The present invention takes advantage of the fact that there are twenty-six letters in the alphabet, i.e., a relatively small number which is easily divided in about halves, fourths, eighths, etc., by the user of the filing system. This is advantageous, for example, when organizing a large number of file folders having a distribution throughout the alphabet in that the individual file folders can be placed into groups corresponding to the about half, fourth, or eighth of the alphabet in which they are desired to be filed as a first pass, and then, in a second pass, those files in the half, fourth, or eighth of the alphabet can more easily be managed to organize the filing system. Likewise, when looking for a desired file folder, the user will know what half, fourth, or eighth of the alphabet the desired file folder is located in, and with the present invention which provides for easily identifying which portion of the alphabet a file folder relates to, allowing the user to easily find the desired file folder within a large group of file folders, even if not correctly organized.

Referring to FIG. 1, the file folder 1 has a first V-shaped notch 2 which is preferably on the top of the front cover 14 of a file folder 1. The V-shaped notch 2 provides a location for the placement of means of identification which includes alphabetical index information, alphanumeric information, bar codes, magnetic strips, etc. In addition, the V-shaped notch 2 provides a visual indication of the contents of the file folder 1 and allows a user access to grasp the contents of the file folder.

The first V-shaped notch 2 provides a uniform reference point for placement of a variety of identifying features such as alphabetical index information 3, alphanumeric information (see 3*a* on FIG. 2 ), bar code 4, magnetic strip 5 and/or any other machine readable label.

It is noted that the first V-shaped notch 2 has a left side 11 and a right side 12. A key feature of the present invention is that one of the left side 11 or right side 12 is marked with a bold strip 13 to indicate what portion of the alphabet the file folder relates to. For example, as shown in FIG. 1, the bold strip 13 is on the left side 11 of the first V-shaped notch 2, indicating that the file folder 1 is desired to be filed in a section relating to the A–L portion of the alphabet. As further described below, it is preferred that the file folder 1 contain additional identifying information to further specify where the file folder 1 is to be filed in the filing system. In the embodiment shown in FIG. 1, since the bold strip 13 is on the left side 11 of the first V-shaped notch 2, preferably, additional identifying information would be located between the left side 11 of the first V-shaped notch 2 and the left side of the file folder 1.

In a preferred embodiment, a machine readable label(s), i.e., bar codes, magnetic strips, etc., is placed near the top on the back cover 17 of the file folder 1 within the confines of the first V-shaped notch 2 (see bar code 4 in FIG. 1 located within outline 16), in which case the first V-shaped notch 2 should be wide enough to accommodate the placement of the machine readable label(s) within its confines. Preferably, a printed outline 16 of the first V-shaped notch 2 is printed on the back cover 17 of the file folder 1 to aid the user in placing a bar code or a magnetic strip in the first V-shaped notch 2, on the back cover. It is preferable to place a label, such as magnetic strip or bar code, on the back cover 17 within the outline 16 of the first V-shaped notch 2 as this provides improved access for a machine scanner to read the magnetic strip or bar code. The improved scanner access is due to an improved scanner reading angle when a group of files are scanned as compared with just labels on the front covers and that the top of the outline 16 will typically not be covered by documents 10.

Additionally, machine readable labels may be placed on either side of the first V-shaped notch 2 or along the left side 11 or the right side 12. The particular arrangement of these labels can vary filing system to filing system, but within a single filing system their placement is preferably uniform on all file folders within the filing system to accommodate rapid scanning of file folders filed within the filing system.

Preferably, the first V-shaped notch 2 is deep enough to allow the user to quickly visually ascertain whether the file folder 1 contains any documents 10. The depth of the first V-shaped notch 2 is designed such that the documents 10 within the file folder 1 are visible within the first V-shaped notch 2 such that the user can easily grasp and retrieve the documents 10. Preferably, the first V-shaped notch 2 is about 2 inches wide and about 1.75 inches deep. An advantage of this design is that the documents can easily be accessed and removed from the file folder, even without removing the file folder from the file drawer or other storage facility.

Preferably, the main identifying information is located within the vicinity of the first V-shaped notch 2. This information preferably includes alphabetical index information that can be rapidly identified by the user and a magnetic strip 5 and/or bar code 4 that can be identified by a scanning device. The alphabetical index information 3 consists of marking the first V-shaped notch 2 in such a way to indicate the portion of the alphabet that corresponds to the documents 10 inside file folder 1. Preferably, each of the left side 11 and the right side 12 of the first V-shaped notch 2 represents a first and a second portion of the alphabet, and preferably, one of the sides 11, 12 of the first V-shaped notch 2 is visibly marked with a bold strip 13 to indicate which portions of the alphabet identify the documents 10 placed in the file folder 1. Most preferably, the first portion of the alphabet comprises the letters A through L and the second portion of the alphabet comprises the letters M through Z.

It is preferable that the first V-shaped notch 2 be placed in the center along the top of the front cover 14 of the file folder 1. However, the invention provides no restriction on where the V-shaped notches may be placed such that filing systems may be optimized for particular uses.

The bar codes or magnetic strips are preferably read by an appropriate scanner connected to a computer and programmed to signal when the data sought or the file sought was sensed or scanned as is known to those of skill in the art. The scanning device would be activated when the scanner was close to the desired magnetic strip or bar code, helping the user to locate the sought after file folder in a cluster or group of other file folders.

In another preferred embodiment, at least one second V-shaped notch 6 or 7 is present on either side of the first V-shaped notch 2. The second V-shaped notch 6, 7 is preferably not as large as the first V-shaped notch 2. The second V-shaped notch 6, 7 provides a location for the placement of additional identifying data.

The smaller second V-shaped notches 6, 7 may be used by the user to facilitate customization of the filing system. Thus, the user may use the area surrounding a smaller second V-shaped notch 6, 7 to provide additional information about the contents of the file, e.g., the client, the product, the time period, etc.

In a preferred embodiment, the upper corners 8 and 9 of the front cover 14 of the file folder 1 are also cropped at an angle to provide a location for the placement of additional identifying information. Preferably, cropping left corner 8 indicates that the documents 10 in the file folder 1 are alphabetically indexed under a first part of the alphabet, preferably A–L; cropping of right corner 9 preferably indicates that the documents 10 in the folder 1 are indexed under the remainder of the alphabet, preferably M–Z.

Referring to FIG. 2, the file folder 21 has a first V-shaped notch 22 and two second V-shaped notches, 26*a*, 26*b*. As shown, the file folder 21 has a first bold strip 23 on the left side of the first V-shaped notch 22, and second bold strip 24 on the right side of the second V-shaped notch 26*a*. These two bold strips and their placement about their respective Vs provide for indicating which about half, fourth, and eighth of the alphabet the file relates to. Here, the bold strip 23 on the left side of the first V-shaped notch 22, represents that the file folder 22 belongs in the first half of the alphabet, i.e., A–L. Each second V-shaped notch 26*a*, 26*b* represents the first fourth and the second fourth, respectively, of the alphabet. The left side of the second V-shaped notch 26*a* indicates letters A–C, i.e., the first eighth of the alphabet; the right side of the second V-shaped notch 26*a*, having bold strip 24, represents D–F, i.e., the second eighth of the alphabet; and likewise with the second V-shaped notch 26*b*, the left side would represent G–I and the right would represent J–L. Thus, a bold strip on a desired side of a V-shaped notch, indicates which half, fourth, or eighth of the alphabet the file folder 21 corresponds too This system of utilizing a larger first V-shaped notch 22 with two smaller second V-shaped notches 26*a*, 26*b*, is particularly useful in large filing systems where it is desired to organize the files in a way corresponding to eighths of the alphabet. For example, in a law firm or large corporation where it is desired that file room personnel refile individual files to insure that they are filed correctly, it is advantageous to provide a drop off place for files after an individual user has completed using the file. With this filing system, the drop off place is organized, labeled, and a location provided according to which eighth of the alphabet the files should be returned to. Thus, when a user is finished with a particular file, he brings the file to the drop off place and places it in the location corresponding to the eighth of the alphabet as marked on his particular file. This presorting makes it easier for the file room personnel to correctly refile files. With the embodiment shown in FIG. 2, this file would be placed in the drop off location designated to hold return files in the second eighth of the alphabet.

Referring to FIG. 3, the upper left hand section of a file folder 31 is shown which shows an alternate embodiment which allows a user to mark each file folder as desired when setting up a file and to customize the filing system to provide additional flexibility for the user. Here, as provided to users, the file folders 31 would preferably have a first V-shaped notch 32 and at least two second V-shaped notches 36*a*, 36*b* with areas for the user to mark bold strips 33, 34 on the desired sides of the first V-shaped notch and the second V-shaped notches. As shown, the user marked first V-shaped notch 32 with a bold strip 33 on the left side of the first V-shaped notch 32 indicating the user's choice that the file belongs in the first half of the alphabet. Alternatively, the first V-shaped notch may have a bold strip on the left side or the right side prior to purchase by the user.

Also shown are two smaller second V-shaped notches, 36*a*, 36*b*. The left side and the right side of each second V-shaped notches 36*a*, 36*b* are provided with an area for the user to mark or darken in as is indicated by the bold strip 34. Also, an aligned dot system provides for indicating the individual letters of the alphabet to which the file folder 31 corresponds. FIG. 3 shows the marking which would be done by the user to indicate the file is to be designated "E."

Referring to FIG. 4, the left upper portion of a file folder 41 is shown. Again, the left side of the first V-shaped notch 42 has a bold strip 43 indicating that the file folder 41 is designated in the first half of the alphabet. The back cover 45 has the first half of the alphabet, A–L, printed to the left of the first V-shaped notch 42. The front cover 44 has dotted lines 46, representing smaller V-shaped notches which may be cut out by the user to correspond with the individual letters A–L printed on the back cover 45 of the file folder 41.

Referring to FIG. 5, shown is a vertical file which has reference numbers corresponding to the embodiment of the file folder shown in FIG. 1. This shows that the filing system of the present invention may be used with either horizontal or vertical files, without limitation.

Referring to FIG. 6, shown is a vertical file designed to be side viewed, such as would be used in a wall mounted filing system. Here, as discussed above, the term "top" refers to the left section of file folder 61 where the first V-shaped notch 62 and bold strip 63 are placed.

A bold strip placed on the side of a V-shaped notch or notches provides for several advantages over the prior art. It provides for the quick sorting of files into smaller groups, such that the smaller groups can more easily be placed in the exact filing order. It also provides a quick, easy, visual indication of which half, fourth, or eighth of the alphabet has been specified for a particular file folder.

Additional features may include a directional line pointing to the Vs on a particular file to help orient the user to the placement of the V-shaped notches. FIG. 6 shows a directional arrow 64 on a side viewed file folder 61. The directional arrow 64 provides an additional location for the placement of identifying information, for example, the name of a particular file (not shown) may be typed on the directional arrow 64.

The markings on the file, including the bold strips on the sides of the V-shaped notches, may be provided with "touch-sensitive" printing such that a visually impaired person may advantageously use the present invention.

The filing system of the present invention provides the user with significant flexibility. Generally, the file folders would be supplied with a bold strip on either the left side or the right side of the first V-shaped notch to indicate a portion of the alphabet for the file, and thereafter, the filing system is designed to optimize a user's flexibility in providing for his individual needs.

A significant advantage of the present invention is that with the marking system disclosed, the user is provided a quick reference to which part of the alphabet a file is related to even if the user is located a significant distance from the file, for example, if the file is located on the other side of a file room or office.

With the prior art folder configurations, often the bar codes or magnetic strips were not placed in a consistent uniform position, such that when a group of folders was scanned, the user would miss certain folders where the magnetic strip or bar code was placed away from where the user attempted to scan the folder. As there is generally no way to indicate when a scanner misses a bar code or magnetic strip on a folder, in prior art systems, it could be particularly frustrating for a user to find desired files.

With the present invention, the placement of the bar code or magnetic strip on the file folder in a known uniform location on each file folder provides the advantage of a scanner or sensor being able to more readily determine if a sought after file is present in a group of file folders.

The present invention also encompasses a method of filing documents using the filing system in which the above described file folders are used.

The present invention gives several advantages over the prior art. The arrangement of alphabetical information around the notches provides a quick reference to easily determine, even from a significant distance, the specific part of the alphabet to which a file is related. Because it is easier to quickly perceive an arrangement of simple shapes than to read text or process color-coding information, the notches of the present invention allow a user to more quickly determine the contents of a particular file by sight. The notches also provides a uniform location for the placement of machine scannable bar codes or magnetic strips, such that a scanning device can be used to quickly search through large volumes of files.

Having described the invention above, various modifications of the techniques, procedures, material, and equipment will be apparent to those skilled in the art. It is intended that all such variations within the scope and spirit of the invention be included within this scope of the appended claims.

I claim:

1. A filing system for allowing a user to identify and access documents, comprising:

at least one file folder having a first V-shaped notch, a front cover and a back cover, said front cover having a top, a left upper corner, and a right upper corner; the first V-shaped notch having a left side and a right side, wherein the left side is designed to represent a first portion of the alphabet and the right side is designed to represent a second portion of the alphabet, and wherein one of the left and right sides of the first V-shaped notch is marked with a bold strip to indicate which of said first and second portions of the alphabet is desired to identify the file folder;

wherein said first V-shaped notch is located in the top of the front cover, is sufficiently deep to allow documents placed in the file folder to be visible, and is sufficiently deep and wide to allow the user access through the first V-shaped notch to grasp documents placed in the file folder; and wherein said first V-shaped notch is designed to provide a location for the placement of means for identification selected from a group consisting of alphabetical index information, alphanumeric information, bar codes and magnetic strips, and combinations thereof.

2. The filing system of claim 1, wherein the first portion of the alphabet comprises letters A–L and the second portion of the alphabet comprises letters M–Z.

3. The filing system of claim 1, wherein said first V-shaped notch is about 2 inches wide and about 1.75 inches deep.

4. The filing system of claim 1, wherein at least one of the left upper corner and the right upper corner of the file folder is cropped and designed to provide a location for the placement of means for identification for identifying the file folder.

5. The filing system of claim 1, wherein the at least one file folder further comprises at least one second V-shaped notch;

wherein said second V-shaped notch is located at the top of the front cover of the file folder; and wherein said second V-shaped notch is designed to provide a location for the placement of means for identification for identifying the file folder.

6. The filing system of claim 5, wherein at least one of the left and right upper corners of the file folder is cropped and designed to provide a location for the placement of means for identification for identifying the file folder.

7. The filing system of claim 1, wherein said means for identification comprises a magnetic strip.

8. The filing system of claim 1, wherein said means for identification comprises a bar code.

9. The filing system of claim 1, wherein said means for identification comprises alphabetical index information.

10. The filing system of claim 1, including at least two file folders, each file folder having a first V-shaped notch, wherein means for identification is placed on each of the at least two file folders; and wherein the placement of the means for identification is in the vicinity of the first V-shaped notch, and the placement of the means for identification is substantially the same for each of the at least two file folders.

11. The filing system of claim 10, wherein each of the at least two file folders each further comprise the back cover having an outline of the first V-shaped notch; and wherein the means for identification is placed on the back cover within the outline of the first V-shaped notch.

12. The filing system of claim 1, wherein the at least one file folder further comprises at least one second V-shaped notch;

wherein the first V-shaped notch is designed to represent a first about half and a second about half of the alphabet; and wherein the at least one second V-shaped notch is designed to represent at least two about fourths of the alphabet.

13. The filing system of claim 1, wherein the at least one file folder further comprises at least two second V-shaped notches;

wherein the first V-shaped notch is designed to represent a first about half and a second about half of the alphabet; and wherein the at least two second V-shaped notches are designed to represent at least four about eighths of the alphabet.

14. A method of filing documents comprising placing at least one document in at least one file folder of the filing system of claim 1.

15. A method for filing documents, comprising the steps of:

choosing at least two file folders, each file folder having a first V-shaped notch having a left side and a right side and at least two second V-shaped notches, each second V-shaped notch having a left side and a right side;

marking one of the left side and the right side of the first V-shaped notch to indicate a corresponding desired first about half or second about half of the alphabet; and marking one of the left side and the right side of a second V-shaped notch to indicate a corresponding desired about fourth or about eighth of the alphabet.

* * * * *